United States Patent [19]

Lewis

[11] Patent Number: 4,586,136

[45] Date of Patent: Apr. 29, 1986

[54] DIGITAL COMPUTER FOR DETERMINING SCUBA DIVING PARAMETERS FOR A PARTICULAR DIVER

[76] Inventor: John E. Lewis, 4524 Palos Verdes Dr., Rancho Palos Verdes, Calif. 90274

[21] Appl. No.: 546,976

[22] Filed: Oct. 31, 1983

[51] Int. Cl.[4] ..... G06F 15/42

[52] U.S. Cl. ..... 364/418; 364/558; 73/291; 128/204.23

[58] Field of Search ..... 364/413, 415, 418, 558; 73/291, 432 R; 128/204.23, 205.23, 905

[56] References Cited

U.S. PATENT DOCUMENTS

| | | | |
|---|---|---|---|
| 3,681,585 | 8/1972 | Todd | 364/418 X |
| 3,992,948 | 11/1976 | D'Antonio et al. | 364/418 X |
| 4,005,282 | 1/1977 | Jennings | 364/418 X |
| 4,054,783 | 10/1977 | Seireg et al. | 364/418 |
| 4,107,995 | 8/1978 | Ligman et al. | 364/418 X |
| 4,109,140 | 8/1978 | Etra | 364/418 X |
| 4,188,825 | 2/1980 | Farrar | 73/291 |
| 4,192,001 | 3/1980 | Villa | 364/418 |
| 4,307,449 | 12/1981 | Strubin | 364/418 |
| 4,336,591 | 6/1982 | Berdzar et al. | 364/418 |

*Primary Examiner*—Gary V. Harkcom
*Attorney, Agent, or Firm*—Reagin & King

[57] ABSTRACT

A device incorporates pressure transducers to measure the ambient water pressure and the pressure of the air in the tank and uses a microprocessor to combine those measurements with a time measurement. The microprocessor provides a digital readout of the tank pressure, the water depth, and the amount of air remaining in the tank calibrated in minutes of air remaining for the particular diver using the tank under the particular circumstances.

3 Claims, 5 Drawing Figures

DIGITAL COMPUTER FOR DETERMINING SCUBA DIVING PARAMETERS FOR A PARTICULAR DIVER

BACKGROUND OF THE INVENTION

This invention relates to diving apparatus and, more particularly, to a device for providing a digital readout of the tank pressure, the depth, and the time remaining to a diver at any particular depth.

Scuba diving has become a popular sport. Scuba equipment gives a person the ability to move relatively freely within wide depth limits through oceans once restricted to the inhabitants, to view those inhabitants and the uniquely picturesque underwater areas, and to photograph the inhabitants and their surroundings. As is well known, however, scuba diving is one sport which retains more than a flavor of danger. Not only are certain inhabitants of the underwater domains dangerous, but the actual practice of the sport itself can be hazardous.

It is well known that as a diver goes deeper, the pressure on his body increases. Of course, the regulator on a scuba tank provides for balancing the lung pressure of a diver with the external pressure of his liquid environment. However, below thirty or forty feet, a diver must be quite careful to surface slowly enough, taking time at each depth as he arises so that he will not experience the bends. In general, this means that a diver must know both the amount of air which remains available to him in his tank at any depth and the particular depth at which he is swimming so that he may make the necessary adjustments in surfacing to eliminate the effects of too rapid decompression.

Usually this is done simply by estimating the depth at which one expects to swim and consulating charts which provide the times to be expected for a particular tank at a given pressure. Of course, unless one swims precisely in accordance with the figures used to determine the particular chart from which the information is taken, the actual times will differ and a dangerous situation may well occur. Because of this inability to accurately determine just how one has swum or to consult charts under water, various arrangements have been devised for providing information regarding tank pressure, depth and the amount of time left with the particular amount of air in a tank. For example, a tank pressure gauge, a watch, and a depth gauge are usually used for this purpose.

However, these instruments, though useful, do not provide direct information regarding air time remaining at a particular depth. None of the instruments devised to date provide a direct measure of the breathing time of a particular diver, that diver's lung capacity, or other information which is necessary to obtain actual air time left in a tank.

SUMMARY OF THE INVENTION

It is an object of this invention to enhance the safety of scuba diving.

It is another object of this invention to make is easier to obtain accurate readings of depth, tank pressure, and air time left in a particular tank or tanks.

It is an additional object of this invention to obtain accurate readings of the air time left in a scuba tank while underwater.

It is yet another object to obtain a reading of air time left in a scuba tank for a particular diver.

These and other objects and features of the invention are accomplished by a device which incorporates pressure transducers to measure the ambient water pressure and the pressure of the air in the tank and combines those measurements with a time measurement to provide a digital readout of the tank pressure, the water depth, and the amount of air remaining in the tank calibrated in minutes of air remaining for the particular diver using the tank. The device utilizes a novel method of determining the lung capacity and the breathing time of the individual diver and updates this information constantly so that the information can be used to give an accurate readout of air time.

In a preferred embodiment of the invention, the device provides, prior to diving, a continuous readout of air time available at different depths so that a diver may predetermine the depth to which he desires to dive and the time he will be able to spend at that depth.

Other objects, features, and advantages of the invention will become apparent upon reference to the specification taken in conjunction with the drawings in which like elements are referred to by like reference characters throughout the several views.

DESCRIPTION OF THE PREFERRED EMBODIMENT

Figure 1:
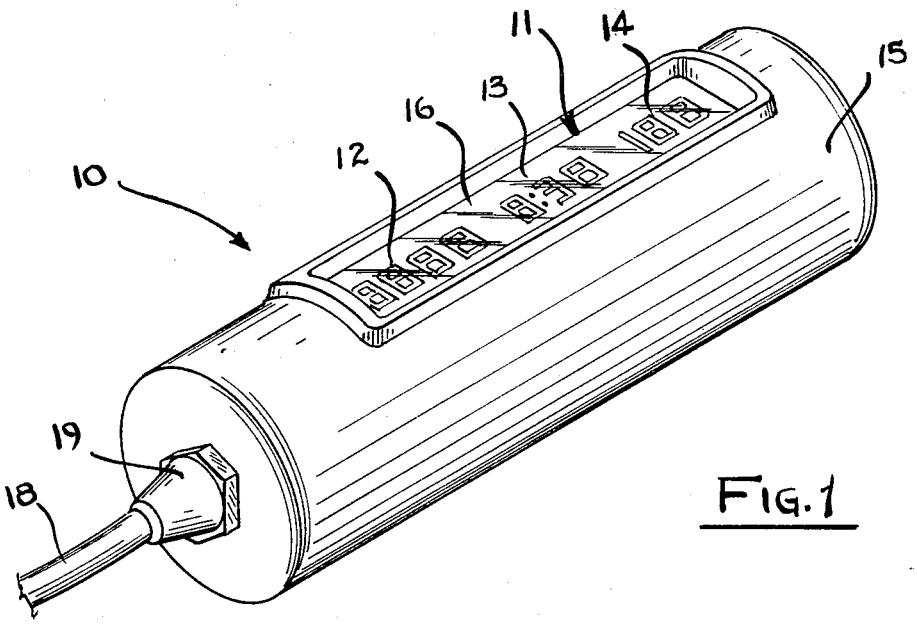
FIG. 1 is a perspective view of a device constructed in accordance with the invention which provides digital readouts of tank pressure, air time, and depth.

FIG. 1 is a perspective view of a device 10 constructed in accordance with the invention. The device 10 includes a digital display 11 which has a tank pressure readout 12 in pounds per square inch, an air time readout 13 in minutes and seconds, and a depth readout 14 in feet. The readouts 12, 13, and 14 are liquid crystal display digits in the preferred embodiment and are enclosed within a case 15 by a transparent face plate 16. The case 15 also carries a pair of pressure transducers (not shown in FIG. 1) for reading the pressure of the ambient water and of the air in a scuba tank (not shown). The tank is connected by a high pressure hose 18 to the device 10 at a connector 19. The connector 19 provides air from the tank at the tank pressure to a high pressure transducer which provides a first input for circuitry contained within the case 15. A second pressure transducer has a pressure sensing input (not shown in FIG. 1) at the other end of the case 15 from the connector 19. This second transducer is used to sense the ambient water pressure to provide a second input to circuitry contained within the case 15.

Figure 2:
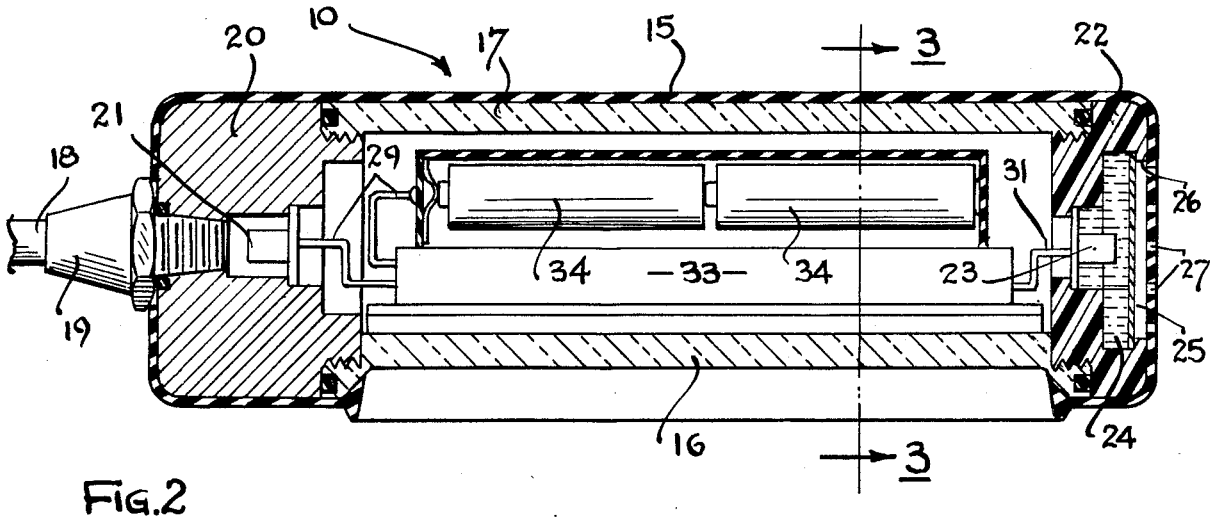
FIG. 2 is a cross sectional side view of the device used in the arrangement shown in FIG. 1.
Figure 3:
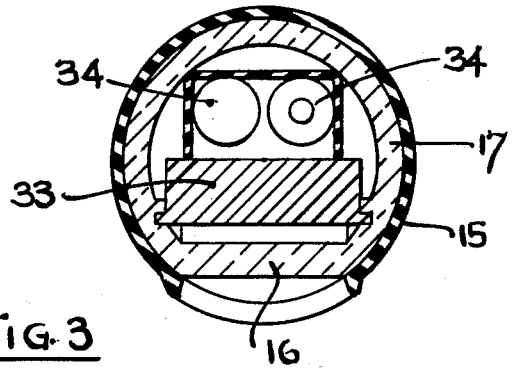
FIG. 3 is a cross sectional end view taken at 3—3 of FIG. 2 of the device used in the arrangement shown in FIG. 1.

FIGS. 2 and 3 are cross sectional views of a mechanical arrangement for accomplishing the invention. As is shown therein, the device 10 includes an exterior case 15 which in the preferred embodiment is a roughened black rubber case adapted to provide a shock resistant exterior and to stretch sufficiently that the device 10 may be assembled and disassembled. This case 15 encloses an interior case 17 which is generally cylindrical and hollow. A first high pressure transducer housing 20 is screw fitted to one end and a low pressure transducer housing 22 is screw fitted to the opposite end of the interior case 17. A first transducer 21 is positioned in the housing 20 to measure the pressure of air from the tank provided by the high pressure hose 18 through connector 19. The housing 22 at the opposite end of the case 17 holds a second transducer 23 positioned to read the ambient water pressure. The transducer 23 sits in a cavity in the housing 20 surrounded by a fluid 24 such as a low viscosity silicon oil held in place by a flexible diaphragm 25 under a lip 26 of the cavity in the housing 22. The case 15 is pierced at the right end adjacent the diaphragm 25 by holes 27 which allow the water to press on the diaphragm 25.

In the preferred embodiment, the interior case 17 may be constructed of a material such as Lexan ®, the housing 20 of stainless steel, and the housing 22 of Lexan ®. Conductors 29 run from the transducer 21 and conductors 31 from the transducer 23 to provide the output therefrom into a circuit 33 shown as a block in FIG. 2.

Figure 4:
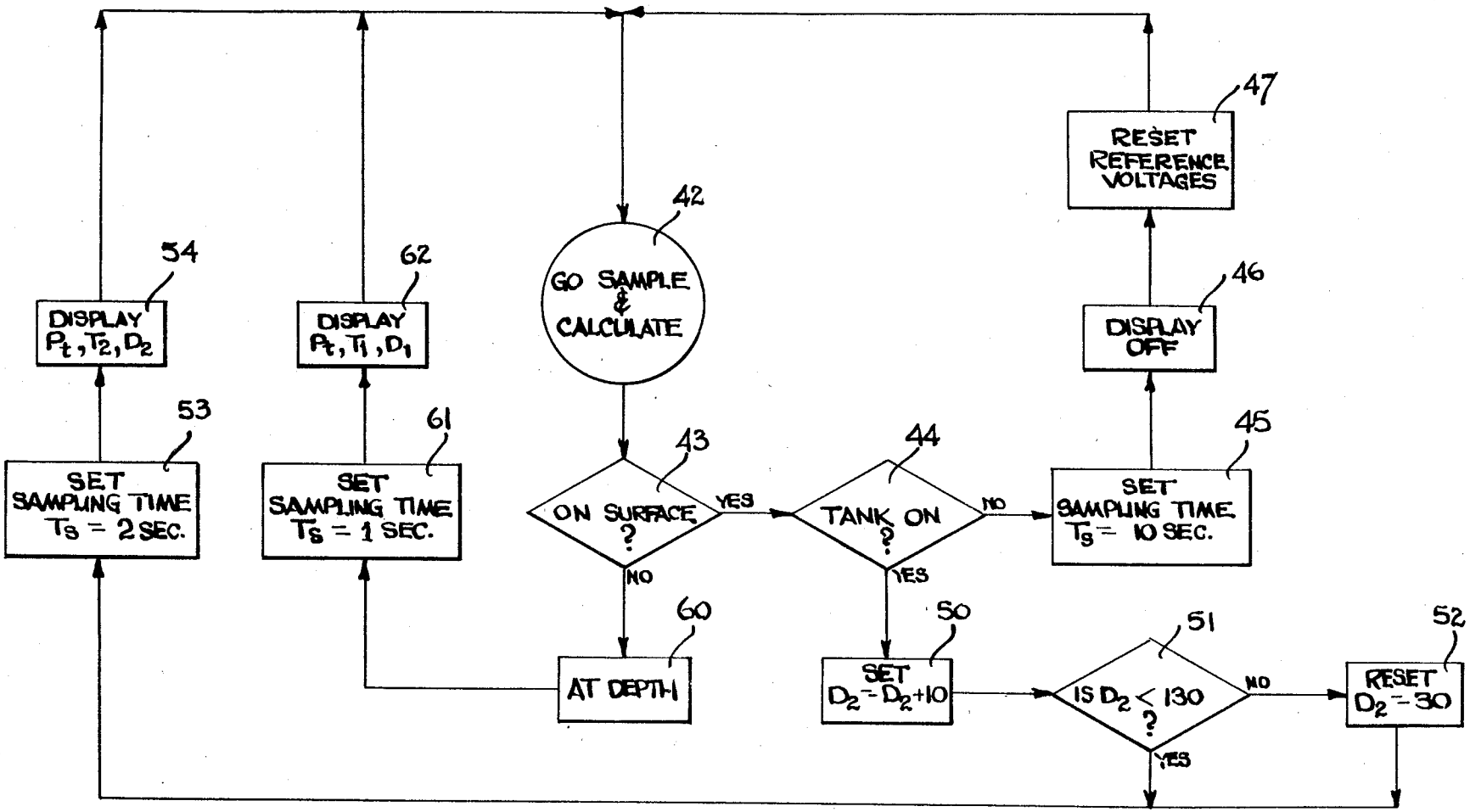
FIGS. 4 and 5 are flowcharts illustrating a program which may be used in mechanizing the device shown in FIG. 1.
Figure 5:
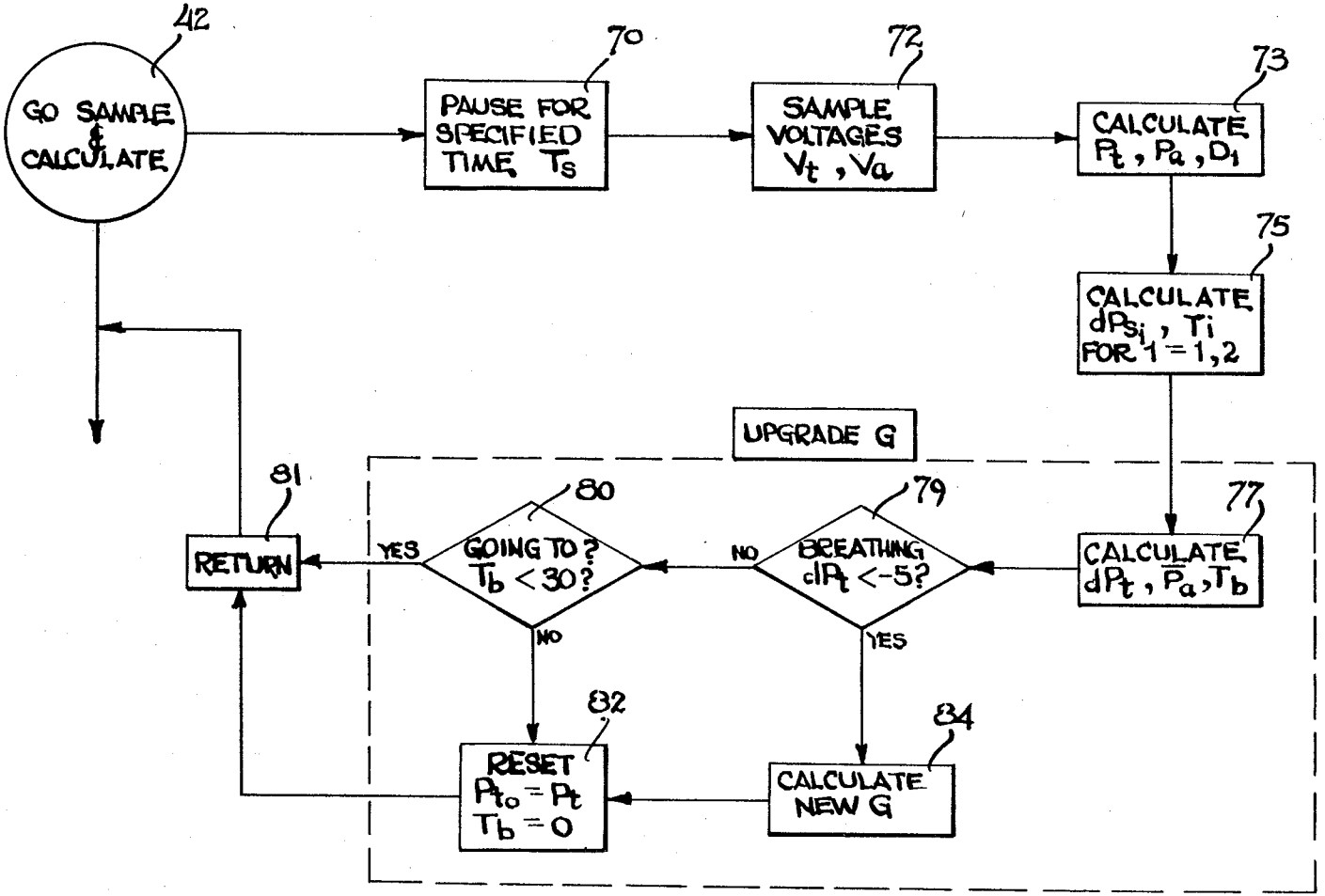

The circuit 33 in the preferred embodiment is an integrated circuit constructed on a single chip of silicon material powered by batteries 34 (four AA batteries in the preferred embodiment) held within the case 17. The circuit 33 is basically a microprocessor circuit, many of which are known to the prior art, which is adapted to utilize the inputs provided by the transducers 21 and 23 to provide the digital indications shown in readouts 12, 13, and 14 of FIG. 1 in response to a program, flowcharts for which are illustrated in FIGS. 4 and 5. In the preferred embodiment a Hitachi LCD III four bit CMOS microprocessor chip is programmed to provide the desired information. The circuit 33 is connected to each of the readouts 12, 13 and 14 by a series of conductors (not shown).

In the preferred embodiment, the transducer 21 is a Sensym Model LX0560A0, 0–3000 pounds per square inch absolute pressure, transducer; and the transducer 23 is a Sensym Model LX0520A0, 0–100 pounds per square inch absolute pressure, transducer.

In general, the operation of the device is as follows. Once the batteries 34 are connected, the device 10 begins operating, and the transducer 21 provides a signal to the circuit 33. This signal indicates that the device has been activated and, if the tank is off, turns off the displays 12, 13, and 14 so that little power is wasted. Once the tank is turned on and the tank is on the surface, as is indicated by the transducer 23, the program provides the present tank pressure on readout 12, a reiterated sequence of different depths at intervals of ten feet between thirty and one hundred and twenty feet on readout 14, and the air time available at each such depth on readout 13.

Once the diver has gone below two feet as shown by the pressure at the transducer 23, the displays 12, 13, and 14 constantly show the tank pressure, the air time available at the particular depth, and the particular depth. Obviously, the tank pressure is read directly by the pressure transducer 21 from the air carried by the high pressure hose 18 from the tank. The depth is calculated from the pressure transducer 23 reading of the water pressure and converting this to depth based on seawater having a specific gravity of 1.03 and a sea level air pressure of 14.7 pounds per square inch.

A straightforward way to obtain the air time remaining would be to equate the air time to the pressure in the tank divided by the change in pressure in the tank multiplied by the time that it takes to make such a change in pressure. However, use of such a formula would require that the estimate of an average diver's breathing time be utilized. If a particular diver's breathing time varied from the preselected time, the resulting air time computed could be dangerously incorrect. Averaging over a longer period of time would provide a better answer but would also result in an erroneous result when a diver was changing depth. For this reason, a unique approach has been taken in the preferred arrangement of circuit 33.

FIG. 4 is a first flowchart illustrating the overall steps by which the circuitry 33 operates to accomplish the purposes of this invention.

Once the batteries 34 are in place, the device 10 is constantly on so that at any time the circuitry is cycling through the following operation. The program begins at step 42 at which a sampling and calculating step takes place which will be discussed below. From step 42, the program oves to step 43 at which a determination is made as to whether the equipment is on the surface by determining whether the pressure read by the ambient pressure transducer 23 is the air pressure expected at sea level. Presuming that the diving equipment is not yet in use, the program moves to step 44 to determine whether the tank has been turned on. If the tank has been turned on, the pressure transducer 21 senses high pressure air through the hose 18. If the tank has not been turned on, the program moves to step 45 at which a sampling time is set to ten seconds in orer to conserve power. From step 45 the program moves to step 46 at which the display of the readouts 12, 13, and 14 is turned off and then to step 47 at which reference voltages provided by the transducers 21 and 23 are sampled and read into memory. At this point, the program is recycled to step 42. So long as the equipment is on the surface and the tank has not yet been turned on, the program continues to recycle through the branch just described.

If, alternatively, the tank is on the surface but has been turned on, from step 44 the program moves to step 50 at which ten feet is added to the depth indication which is to be shown on the display. From step 50 the program moves to step 51 at which a determination is made as to whether the projected depth is less than one hundred and thirty feet. If it is not, i.e., once the depth indicated has passed one hundred and twenty feet, the depth to be indicated is reset to thirty feet so that a reiteration of depths and air times may be shown. The calculations of these steps give a depth against which an air time will be calculated for that depth. The program steps through depths from thirty feet to one hundred and twenty feet in ten foot increments in the preferred embodiment, displaying these depths in order on the readout 14 and the air time at each depth on the readout 13. In this way, a diver may conveniently pre-plan his dive.

From step 52 in the case at which the depth is set to thirty feet and from step in the case which the depth is less than one hundred and thirty feet, the program moves to step 53 to set the sampling time for the program to two seconds. From step 53 the program moves to step 54 at which the tank pressure, the air time available to the diver at the particular depth displayed, and the particular depth in ten foot increments is given. The program moves from step 54 back to step 42.

If the equipment is not on the surface, i.e. the equipment is being used for diving, the program moves from step 43 to step 60 and then to step 61 at which the sampling time is reset to a one second interval to give more precise calculations. From step 61 the program proceeds to step 62 at which the displays 12, 13, and 14 are operated to show the present tank pressure, the air time available to the particular diver at that particular depth, and that particular depth, respectively, as calculated at step 42. The program then recycles to step 42.

FIG. 5 is a flowchart illustrating the process by which the sampling and calculation of values to obtain the information to be displayed is accomplished in accordance with the invention. The program moves from step 42 to step 70 at which a pause takes place for a duration equal to the sampling time presently utilized. For example, if the diving equipment is on the surface and the tank is off, the sampling time is ten seconds; if the tank is on but the equipment is on the surface, the sampling time is two seconds; and if the tank is on but the equipment is below the surface, the sampling time is one second.

The program moves from step 70 to step 72 at which the voltages at the two transducers 21 and 23 ($V_t$, $V_a$, respectively) are sampled. The program then moves to step 73 at which the tank pressure, the absolute ambient pressure, and the depth of the equipment in feet is calculated (in accordance with the following equations in the preferred embodiment):

$$P_t = A_t dV_t + B_t dV_t^2 + C_t dV_t^3;$$

$$dV_t = V_t - V_{to}$$

$$P_a = A_a dV_a + B_a dV_a^2 + C_a dV_a^3 + 14.7;$$

$$dV_a = V_a - V_{ao}$$

$$D_1 = (P_a - 14.7)/0.446$$

where $A_t$, $B_t$, $C_t$ and $A_a$, $B_a$, $C_a$ are calibration constants; $V_{to}$ and $V_{ao}$ are reference voltages that correspond to a pressure of one atmosphere; $P_t$ is the tank gauge pressure; $P_a$ is the absolute ambient pressure; and $D_1$ is the depth in feet of sea water.

As may be seen from these equations, the change in the reading at the transducer 21 is used to provide the present tank pressure; the change in the reading at the transducer 23 is used to determine the ambient pressure; and the depth is calculated from the ambient pressure.

The program then moves to step 75 at which a determination is made of the tank pressure required for surfacing from the depth presently being measured and the air time remaining at the particular depth. This information is calculated presuming a sixty foot per minute ascent to the surface and a three hundred psi tank reserve after surfacing. At this time when the equipment is on the surface and the tank is on, the same information is also calculated for the depth next to be displayed. These values are calculated in accordance with the following equations:

$$dP_{si} = [14.7\,(D_i/60) + 13.38\,(D_i/60)^2]/G$$

$$T_i = G \cdot (P_t - dP_{si} - 300)/(14.7 + 0.446\,D_i)$$

$$i = 1,2$$

where $dP_{si}$ is the pressure required for surfacing, i.e., the estimated drop in tank pressure during a sixty foot per minute ascent to the surface; $T_i$ is the air time remaining at depth that will allow for a three hundred psi reserve following a direct ascent to the surface; and $i=1$ refers to the present depth and $i=2$ refers to the projected depth of the next dive when the equipment is on but on the surface. The term G is a factor which is uniquely dependent on the particular diver's tank volume, his own lung capacity, and the breathing rate of the particular diver.

It should be noted that the factor G is included in computing air time both under the surface and before diving. Consequently, the air times may be determined quite accurately during both the pre-planning and diving stages.

From step 75 the program moves to a series of steps in whcih the unique breathing parameter G of the particular diver using the equipment is calculated. In step 77 values are calculated for the change in tank pressure, the average absolute ambient pressure during the breathing period of the diver which was last sampled, and the length of the breathing period of the diver. These values are calculated in accordance with the following equations in the preferred embodiments:

$$dP_t = P_t - P_{to};$$

$$P_{to} + P_t$$

when $T_b = 0$ $$P_a = (P_a \cdot T_b + P_a \cdot T_s)/(T_b + T_s)$$

$$T_b = T_b + T_s$$

where $dP_t$ is the change in tank pressure, $P_a$ is the average absolute ambient pressure during the previous breathing period of $T_b$, and $T_s$ is the sampling period.

It will be seen that the change in tank pressure is the change since the breathing period began. The average ambient pressure during the breathing period combines the pressure from the previous period and the present measurement to reach an average. The breathing time is computed by summing the sampling periods until a breath is taken.

From step 77, the program moves to step 79 in which a determination is made as to whether the diver is breathing by sampling the change in tank pressure since the last iteration. If at this step, the diver is not yet breathing, the program moves to step 80 in which a determination is made as to whether the breathing time is less than thirty seconds i.e., whether he can be expected to breath again. If the breathing time is less than thirty seconds, the program moves to step 81 and returns to the main program at step 42. If the time since the last breath is over thirty seconds, the program moves to step 82 where the initial tank pressure is reset to the present tank pressure and the breathing time is reset to zero. This presumes the data is inaccurate at this point and needs to be recomputed. The program then returns through step 81 to step 43 of the main programme shown in FIG. 4.

If a step 79 the tank pressure has changed sufficiently indicating that the diver is breathing, the program moves to step 84 at which a new average breathing parameter for five breathing periods is calculated in accordance with the equations:

$$G' = P_a \cdot T_b / dP_t;$$

$$G=0.8\ G+0.2\ G'$$

where G' is the value of the breathing parameter during the previous time to $T_b$; and G is the average over the previous five periods.

It will be noted that the parameter G is reached by taking the average G for the last four breathing periods and modifying it by the present determination so that large swings are averaged by the total.

The program moves from step 84 to step 82 where the initial tank pressure and the breathing time are both reset so that the next breathing period may be computed and then returns to the main program through step 81.

Thus, as may be seen, the device may 10 of the present invention constantly recomputes the breathing parameter of the particular diver to provide up-to-the-second information as to tank pressure, depth, and air time at depth. This information allows the diver substantially more freedom and security than any presently available.

This series of steps which allows a continuous updating of the breathing characteristics of a diver under any particular circumstance provides the most accurate estimate of tank air time which is possible. This allows a diver to know at any time just what his air requirements are if he stays at the same depth and, as he changes to another depth, what the requirement are at that depth.

As will be understood by those skilled in the art, various other arrangements than those shown in the specification will occur to those skilled in the art without departing from the spirit and scope of the invention. It is therefore to understood that the invention is to be limited only by the scope of the claims appended hereto.

What is claimed is:

1. A device for use by a scuba diver comprising:

means for measuring the pressure of the breathing gas within the diver's tank;

means for measuring the ambient pressure;

means for measuring time;

means for utilizing the measurement of ambient pressure to determine the depth of a diver;

means for determining the change in pressure of the breathing gas within the diver's tank;

means for determining the length of a breathing period for a diver using the diver's tank;

means for utilizing the ambient pressure, the length of a breathing period of a diver, and the change of pressure of the breathing gas to determine a breathing gas consumption factor for a particular diver; and means for utilizing the pressure of the breathing gas in the diver's tank, the breathing gas consumption factor, and the depth to determine the breathing time remaining to a particular diver at the particular depth.

2. A device as claimed in claim 1 in which the means for utilizing the pressure of the breathing gas in the diver's tank, the breathing gas consumption factor, and the depth to determine the breathing time remaining to a particular diver at the particular depth further includes means for adding a time to allow the safe assent by a diver at the particular depth.

3. A device as claimed in claim 1 further including means for displaying to a diver the present depth and the time remaining at the depth.

* * * * *